United States Patent [19]

Denay et al.

[11] 4,230,262

[45] Oct. 28, 1980

[54] CONTINUOUS STRIP OF SEALED ENVELOPES WITH INNER DOCUMENTS

[75] Inventors: André M. J. Denay, Chevilly Larue; Pierre M. J. Bougé, Paris, both of France

[73] Assignee: Herve et Fils, S.A., Paris, France

[21] Appl. No.: 870,783

[22] Filed: Jan. 19, 1978

[30] Foreign Application Priority Data

Jan. 26, 1977 [FR] France ..... 77 02163

[51] Int. Cl.[3] ..... B65D 27/10

[52] U.S. Cl. ..... 229/69; 282/11.5 A

[58] Field of Search ..... 229/69, 70; 282/11.5 R, 282/11.5 A

[56] References Cited

U.S. PATENT DOCUMENTS

| | | | |
|---|---|---|---|
| 1,126,411 | 1/1915 | D'Arey | 229/70 |
| 3,104,799 | 9/1963 | Steidinger | 229/69 |
| 3,325,188 | 6/1967 | Hiersteiner | 229/69 |
| 3,554,438 | 1/1971 | Van Malderghem | 282/11.5 A |
| 3,608,816 | 9/1971 | Neubauer | 206/610 |
| 4,010,889 | 3/1977 | Allen et al. | 229/69 |

FOREIGN PATENT DOCUMENTS

| | | | |
|---|---|---|---|
| 2135398 | 5/1971 | France | 229/69 |
| 2224999 | 10/1974 | France | 282/11.5 A |
| 2291866 | 6/1976 | France | 282/11.5 A |
| 2291867 | 6/1976 | France | 282/11.5 A |
| 1249054 | 10/1971 | United Kingdom | 229/69 |

*Primary Examiner*—Stephen P. Garbe

*Attorney, Agent, or Firm*—Edwin E. Greigg

[57] ABSTRACT

A complex continuous strip folded accordion-wise of which each flap constitutes a correspondence envelope obtained by lateral adhesion of continuous sheets, namely an upper sheet to constitute the wall of the face of successive envelopes, a lower sheet to constitute the back wall of said envelope and, if necessary, intermediate sheets to constitute inner documents. These intermediate sheets are made fast together and to the upper and lower sheets by gluing over the whole periphery of each of the unit covers or including transverse cutouts permitting gluing at the head and at the foot of the walls of each unit envelope. The strip is provided on each of its lateral sides with drive perforations situated on a marginal zone and, if necessary covered by a check strip to be removed before the unitization of the envelope. The structure of the sheets is such that one at least of the inner documents is noticeable from the outside of the sealed envelopes of the strip in order to detect its presence and if necessary its nature.

4 Claims, 2 Drawing Figures

F
11
13
20
19
18
17
21
23
25
11
41
14
24
26
18
11
17
41
15
20
16
20
17
22
12

F
124
113
132
121
120
119
114
122
116
120
119
131
278531
(011001110)
130
43
44
46
48
47
ABC
DEF

CONTINUOUS STRIP OF SEALED ENVELOPES WITH INNER DOCUMENTS

BACKGROUND OF THE INVENTION

1. Field of the Invention

The invention relates to covers in a continuous strip for correspondence or for the distribution of confidential information.

2. Description of the Prior Art

It is known to manufacture wads or packets of continuous sheets folded accordion-wise of which each flap constitutes a single cover. These products to which the English name of "mailers" is generally given enable production on a printing machine such as the printer of a computer, of electro-accounting equipment, or the like, the lower sheet of the packet is intended to form for each of the flaps of the accordion fold, that is to say for each of the unit covers the back of the envelope of the cover concerned, whilst the upper sheet forms the faces of the envelopes. All the intermediate sheets are intended to constitute inner documents or inserts of each of the covers. According to known arrangements (carboned areas, chemical papers or self-reproducing elements possibly in zones, etc.) the impression of the printer is brought back selectively on certain of the sheets, hence on certain of the inner documents whilst non-personalized endorsements, that is to say identical for all of the covers are printed on one or several sheets before their assembly. The packet almost always includes in addition a covering strip, called the archive or control strip, which covers the upper sheet.

Apart from the control strip, all the sheets of the packet are united by glueing along their natural edges, with the exception, possibly, of certain intermediate sheets which can be narrower than the others and in this case packaged along one only of their lateral edges. Each of the flaps or covers is sealed at the head and at the foot by transverse threads of glue. Mostly these threads unite the upper and lower sheets through transverse cutouts formed on all the intermediate sheets.

Detachable lines of perforation and/or rupture initiation enable the opening of the covers by the addresses and the extraction of the inner documents.

Lastly, on each of its lateral sides, the packet is provided with drive perforations situated on a detachable marginal area. These perforations serve for driving the packet in the printing machine and then in the unifying device, but they also serve for driving each of the sheets in the packet assembly machine (called an assembler or collator) and they pre-exist on each of said sheets (on a single side for the narrower sheets).

After the passage into the printer the package is brought to a unifying device where after removal of the possible cover strip, the covers are separated from one another along accordion fold lines, either by rupture by pulling, or by cutting (guillotine). Very often at the input of the device longitudinal cutting trimmers detach the marginal zones bearing the drive perforations, but this arrangement is not obligatory.

In the collator which effects the manufacture of the assembly, each continuous sheet provided with its marginal drive perforations unrolls from a reel and follows a particular circuit in the course of which it passes through a succession of work stations where the necessary fashioning is carried out (weakening lines for the accordion folding, lines of detachable perforations or rupture initiation, cutouts, glueing, etc.).

In spite of the precautions taken and the safety devices (presence detectors), when a reel is emptied a gap can occur and some of the flaps of the package can be devoid of the sheet corresponding to said reel. The same accident can occur each time that a strip is restored into circulation, as a result of a breakage for example. This absence is undetectable in the course of subsequent processing when it relates to an intermediate sheet and the corresponding covers arrive at their addressees with an inner document lacking.

This lack is of somewhat less importance when it relates to commonplace documents, but it can be serious when it relates, for example, to an invoice, a pay check an acknowledgement of receipt, etc., and even very serious in the case of a summons, a cheque or other document whose "actual" dispatch must be checked. That is a serious drawback of the present "mailers".

In the case of a cheque or other document numbered in advance (by printing or by stamping) before the packaging of the continuous sheets, the "mailers" at present known have another drawback. For cheques for example, the bank drawn upon attributes to its customer a certain sequence of numbers within a given series, then another sequence in another series, etc. The customer himself has the cheques printed with their numbers (order and series) and must inform the bank of the cheques issued generally in the following form:

| | |
|---|---|
| Date . . . . . , | check series X n°. . . . . to . . . . . |
| | check series Y n°. . . . . *to* . . . . . |

It is hence necessary for the user of the "mailer" to preserve a visible trace of the numbers of the checks dispatched although the latter (inner documents of covers sealed in manufacture) cannot be read after their passage in the printer. The only present means of marking consists of printing these numbers on a cover or control strip at the same time as on the intermediate continuous sheet intended to form the sequence of checks. One has thus on the control strip the list of numbers of the cheques it has used and sent out, but on condition that, on the one hand, the marking of the cover strip and the continuous sheet of cheques be correct at the moment of assembly into a packet and that, on the other hand, an accidental gap does not occur (as above) in the intermediate sheet.

It is an object of the "mailer" according to the invention to overcome these drawbacks.

Other objects and advantages of the invention will become apparent on reading the description which follows.

GENERAL DESCRIPTION OF THE INVENTION

According to the invention there is provided a strip wherein one at least of the intermediate sheets is wider than the upper and lower sheets so as to overlap the latter laterally on one at least of the sides, the corresponding marginal drive perforations of the complex strip being then situated in the vicinity of the free edge of this overlapping.

It is clear that any lack of an inner document corresponding to the overlapping intermediate sheet is thus not only made visible but necessarily and immediately detectable since it results in a gap in continuity in at least one line of drive perforations and thus prohibits passage in the printer.

If this document is a numbered or coded document, the corresponding intermediate sheet receiving by stamping a sequence of numbers or of codes on its successive flaps before assembly of the complex strip, it suffices to provide on each of the flaps a repetition or an identification of the number or of the inner code on the overlapping part. A longitudinal cut of the overlapping part after passage into the printer will enable checking of the numbered documents sent out without the fear of bad marking. This longitudinal cut can take place either before the unification, and then a continuous marginal control strip is obtained, namely same time as the unitisation, and there is thus obtained a plurality of individual check stubs or counterfoils. Of course a Y impression or a repeat impression can enable the application on the overlapping part (hence on the marginal strip or the check stubs) any or part of the personalized data reported selectively on the inner documents.

The cover or check strip of the complex strip then becomes unnecessary, its only purpose consisting of "memorizing" the information impressed by the printer and which must not appear on the upper sheet, that is to say on the face of successive envelopes. Now arrangements are known which enable this memorizing without calling upon a cover strip. For example: impression of the printer with an un-inked ribbon with self-reproducing zoning on the upper sheet or with a cutout window on the upper sheet and first self-reproducing inner document. To have a complete control document, it suffices for at least the overlapping part of the intermediate sheet to be self-reproducing or for the printer ribbon to include an inking on a longitudinal strip corresponding to said overlapping part.

In the particular case where, according to French Pat. No. 71 15859 in the name of the same Applicant, the complex continuous strip includes, apart from the possible covering or control strip, only sheets without transverse cutouts united together by glueing the peripheral parts of each of their flaps, a frame of detachable perforations extending towards the inside the glue lines to enable the opening of each of the covers by tearing a peripheral strip and the upper sheet, intended to constitute the facing wall of successive envelopes, forming a mask for the sub-adjacent sheet and generally having an opening of suitable shape corresponding to the place of the address of the addressee, the same arrangement can be adopted. One at least of the sheets may be wider than the others so as to overlap the latter laterally on at least one of the sides, the corresponding marginal drive perforations of the complex strip being then situated in the vicinity of the free edge of this overlapping part.

It is also an object of the invention to provide another means of checking the presence of an insert inside a "mailer". This means consists of arranging on each of the flaps of the upper sheet and, if necessary, of the intermediate sheets which precede that intended to form the insert whose presence must be checked, at least one opening through which the insert appears or a printed sign on said insert in order to enable visual, optical, magnetic or other detection.

It is also possible to provide a plurality of aligned or unaligned openings, corresponding to a plurality of possible positions for one or several signs borne by the insert. It is clear that according to the arrangement of the one or more "occupied" openings, a code is thus constituted, binary for example, which can be perceived or checked visually, optically, or magnetically.

The same openings provided on the so-called return envelope, often provided inside the "mailer" to enable the dispatch of the reply by the initial addressee, will enable by visual, optical or magnetic reading, identification in the same way of a "response" code without having to open the envelope.

BRIEF DESCRIPTION OF THE DRAWINGS

The invention will be better understood on reading the description which follows and examination of the accompanying drawings in which.

DESCRIPTION OF A PREFERRED EMBODIMENT

Figure 1:
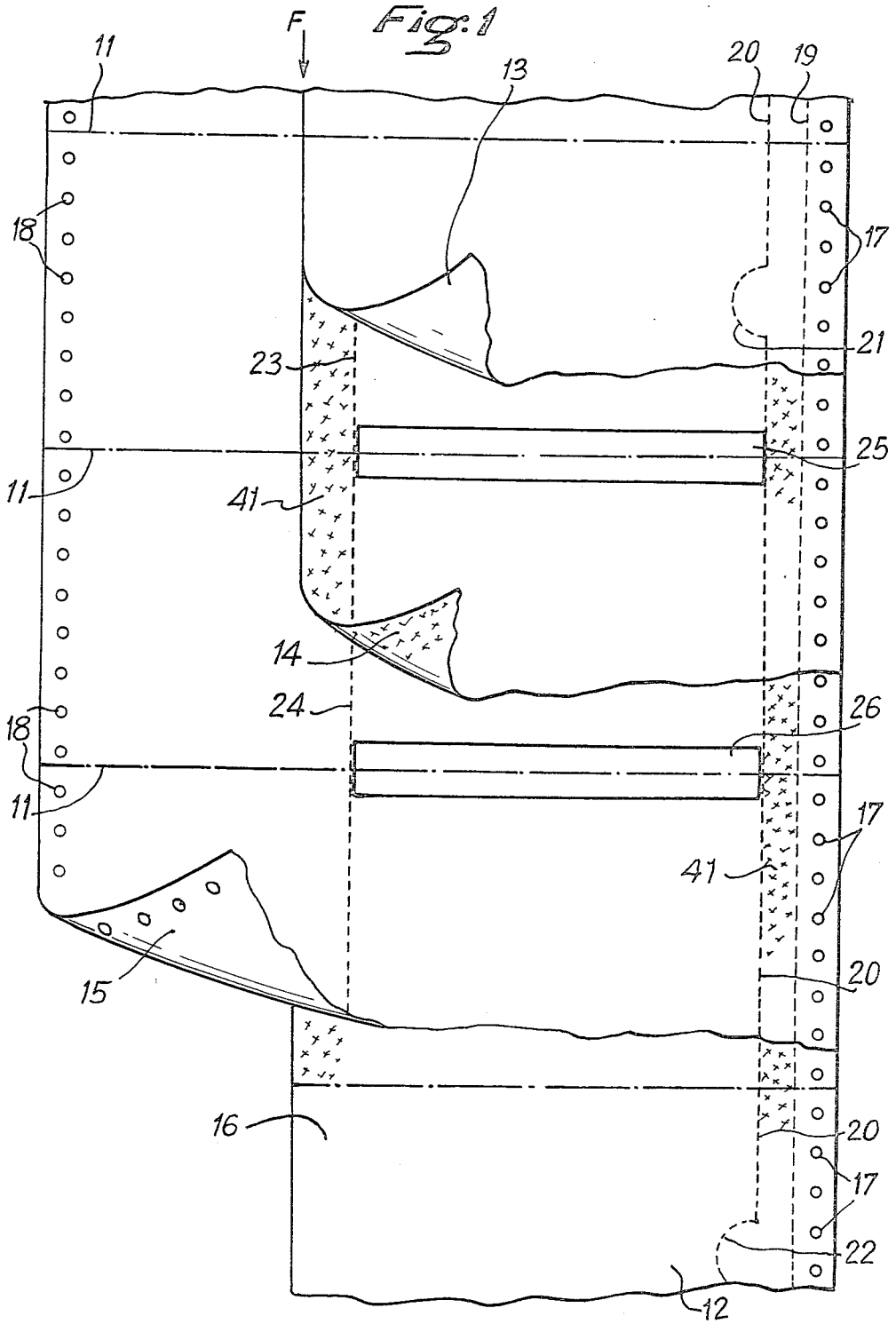
FIG. 1 shows a complex strip according to the invention with two intermediate sheets of which one is overlapping.

In FIG. 1, a complex strip is designed to be folded accordion-wise along transverse weakening lines 11 (indicated in mixed lines). Each flap of the accordion folding constitutes an envelope of correspondence with incorporated inner documents (two inner documents in the example shown).

The complex strip is formed by the assembly of four continuous sheets, namely: a lower sheet 16 and an upper sheet 13 intended to constitute respectively the back wall and the front wall of each of the elementary envelopes and two intermediate sheets 14 and 15 intended to constitute the inner documents.

The sheets 13, 14 and 16 are of the same width and the sheet 15 is larger than the others. All the sheets are "tacked" on the righthand side and bear along their corresponding lateral edge conjugated drive perforations 17. The sheet 15 bears along its opposite edge drive perforations 18. The marginal zone including the drive perforations 17 is bounded by a line of detachable perforations 19 but this arrangement is not obligatory and mostly this zone is cut during passage in the unitising machine without the aid of said perforations.

In known manner, all the sheets include a longitudinal line of detachable perforations 20 parallel to 19 and at a short distance from the latter. On the upper 13 and lower 16 sheets, this line is interrupted at mid-height of each flap of the accordion folding by a half-moon 21, 22 pre-cutout. On each intermediate sheet there is provided a longitudinal line 23, 24 for rupture initiation. The lines 23 and 24 are coinciding and situated at a relatively short distance from the edge, opposite the line of perforations 20 of the narrowest intermediate sheet 14.

On each intermediate sheet rectangular cutouts 25, 26 each straddling weakening lines 11 extend between the line of perforations 20 and the line of rupture 23, 24.

The assembly of the sheets is effected by glueing. The threads of glue 41 are arranged toward the right between the lines of perforations 19 and 20 and, opposite, between the edges of the sheets 13, 14 and 16, the lines of rupture 23, 24. In addition, the sealing of the head and foot of each envelope is effected by transverse glueing of sheets 13 and 16 through the cutouts 25, 26.

One is thus certain of the presence, in each envelope, of the inner document derived from the sheet 15, due to the overlapping part of the latter. If such a document were missing, the alignment of the perforations 18 would be interrupted and the subsequent passage in the printer would be impossible.

During the unitisation, the overlapping part of the sheet 15 is generally cut longitudinally (along the arrow F) either before to obtain a strip, or at the same time to obtain a plurality of stubs. This strip or these stubs can serve for checking if they bear pre-printed indications and/or impressions by the printer.

However the cut F is not obligatory and may be replaced by a line of detachable perforations, each envelope being then dispatched with a counterfoil which can constitute an acknowledgement of receipt.

The opening of the envelope by the addressee is done conventionally by lateral tearing (or pulling off) along the line of perforations 20, the half-moons enabling the inner documents to be seized and pulled off by means of the rupture initiation lines 23, 24.

Of course, the sheet 15 could overlap the others on each of the sides of the strip. It would then be the only one to bear the drive perforations and one could have two check strips (or one check strip and one "receipt acknowledgment" counterfoil). In the same way the sheet 15 being such as shown, the sheet 14 could overlap on the opposite side and bear corresponding drive perforations.

Figures 2, 3:
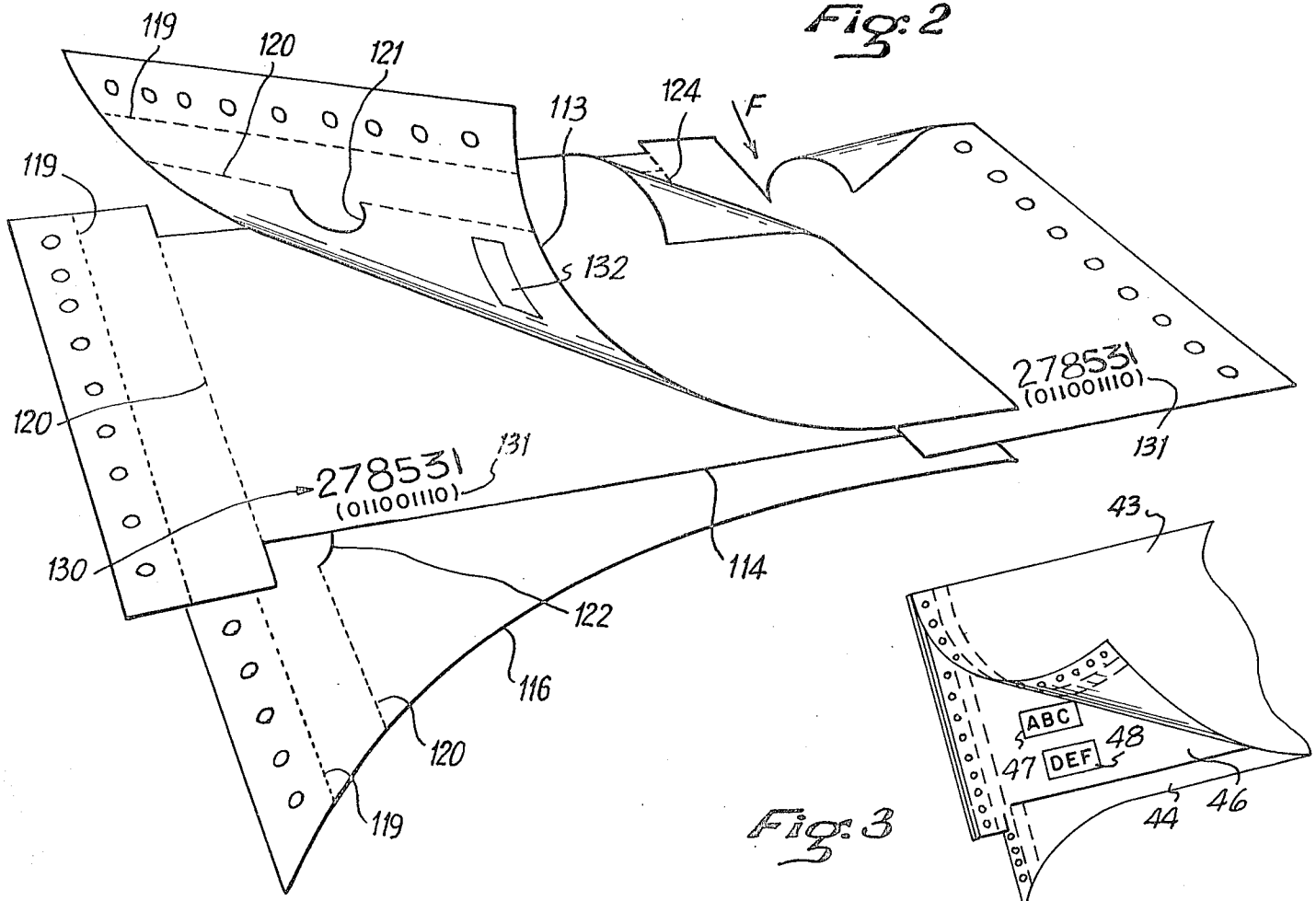
FIG. 2 is an opened out view of an envelope with an inner numbered document.
FIG. 3 is a perspective view of a portion of another embodiment of the invention.

FIG. 2 shows an envelope opened out coming from a complex strip with a single intermediate sheet, the marginal zone of drive perforations common to all the sheets being uncut. There is again to be seen a back 116 and a front 113 of the envelope with an overlapping inner document 114, lines of detachable perforations 119, 120, half-moons 121 and 122, and a rupture initiation line 124. In this example, the inner document bears a pre-printed number 130 and this number is repeated on the overlapping part of the document, which permits after the cut F the trace of the numbers of the dispatched documents to be preserved. This repetition can be replaced by a number identification code. In place of the pre-printed number 130, the inner document can include in the same way a code 131 which will be repeated or translated otherwise on the overlapping part.

If desired, the sheet forming the front 113 of the envelope may be provided with an opening 132 through which the number 130 or code 131 may be viewed.

In FIG. 3 there is shown another embodiment of the invention wherein the elementary envelope includes an upper sheet 43 and a lower sheet 44 which constitute, respectively, the front wall and back wall of the elementary envelope. The inner document 46 comprises a return envelope provided with a plurality of openings 47, 48 corresponding to a plurality of possible locations for at least one identifying indicia borne by the document to be readdressed by the initial addressee so as to constitute a reply code, identifiable by visual, optical or magnetic reading without opening of the cover.

We claim:

1. A complex continuous strip folded accordion-wise into a plurality of successive flaps of which each flap constitutes a correspondence envelope comprising a plurality of continuous sheets laterally joined together, said plurality of sheets including an upper sheet constituting the front wall of successive envelopes, a lower sheet constituting the back wall of said envelopes, and at least one intermediate sheet constituting an inner document having an outer marginal edge portion, said intermediate sheet adhesively secured to said upper and lower sheets, said complex strip being provided on each of its lateral sides with drive perforations situated in a marginal zone, said inner document having said outer marginal edge portion extending to the outside of the sealed envelopes of the strip in order to detect its presence and identity, said outer marginal edge portion of said inner document also being provided with said drive performations, said at least one intermediate sheet, which constitutes said inner document whose presence must be checked, being wider than the upper and lower sheets so as to provide said outer marginal edge portion along one side, said outer marginal edge portion having a length corresponding substantially to the length of said envelope.

2. A complex strip according to claim 1 in which said inner document of each said envelope is an identified document, said at least one intermediate sheet constituting said identified document in successive envelopes being provided with a series of identifying indicia on successive inner documents before assembly into a packet of said complex strip, said at least one intermediate sheet overlapping said envelope laterally to provide an overlapping portion on which said identifying indicia on said document is repeated.

3. A complex continuous strip according to claim 2, in which said inner document constitutes a return envelope, and wherein one of the walls of each return envelope is provided with a plurality of openings, corresponding to a plurality of possible locations for at least one identifying indicia borne by the inner document to be readdressed by the initial addressee, so as to constitute a reply code, identifiable by visual, optical or magnetic reading without opening of the cover.

4. A complex continuous strip according to claim 1, in which said inner document constitutes a return envelope, and wherein one of the walls of each return envelope is provided with a plurality of openings, corresponding to a plurality of possible locations for at least one identifying indicia borne by the document to be readdressed by the initial addressee, so as to constitute a reply code, identifiable by visual, optical or magnetic reading without opening of the cover.

* * * * *